US010563949B2

(12) United States Patent
McPherson et al.

(10) Patent No.: US 10,563,949 B2
(45) Date of Patent: Feb. 18, 2020

(54) CROSSBOW BUMPERS

(71) Applicant: MCP IP, LLC, Sparta, WI (US)

(72) Inventors: Mathew A. McPherson, Norwalk, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/150,159

(22) Filed: Oct. 2, 2018

(65) Prior Publication Data

US 2019/0170474 A1 Jun. 6, 2019

Related U.S. Application Data

(60) Provisional application No. 62/567,092, filed on Oct. 2, 2017.

(51) Int. Cl.
*F41B 5/12* (2006.01)
*F41B 5/14* (2006.01)

(52) U.S. Cl.
CPC ..... *F41B 5/123* (2013.01); *F41B 5/12* (2013.01); *F41B 5/1469* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 6,651,641 | B1 | 11/2003 | Bower et al. | |
| 6,901,921 | B1 | 6/2005 | Barnett | |
| 7,328,693 | B2 | 2/2008 | Kempf | |
| 7,363,921 | B2 | 4/2008 | Kempf | |
| 7,832,386 | B2 | 11/2010 | Bednar et al. | |
| 7,836,871 | B2 | 11/2010 | Kempf | |
| 7,930,849 | B2 | 4/2011 | Abraham et al. | |
| D730,478 | S | 5/2015 | Sims | |
| 9,121,659 | B1 * | 9/2015 | Chang | F41B 5/123 |
| 9,417,029 | B1 * | 8/2016 | Chang | F41B 5/143 |
| 9,618,294 | B2 | 4/2017 | McPherson | |
| 9,671,189 | B2 | 6/2017 | McPherson | |
| D792,936 | S | 7/2017 | Eitan et al. | |
| D792,937 | S | 7/2017 | Eitan et al. | |
| 10,126,088 | B2 * | 11/2018 | Yehle | F41B 5/123 |
| 2002/0020403 | A1 | 2/2002 | Troubridge | |
| 2008/0168969 | A1 | 7/2008 | Kempf | |
| 2010/0186728 | A1 | 7/2010 | Bednar et al. | |
| 2011/0203561 | A1 | 8/2011 | Shaffer et al. | |
| 2012/0298087 | A1 | 11/2012 | Trpkovski | |
| 2013/0061836 | A1 | 3/2013 | Kempf | |
| 2016/0290757 | A1 | 10/2016 | Khoshnood | |

* cited by examiner

*Primary Examiner* — John A Ricci

(57) ABSTRACT

In some embodiments, a crossbow comprises a bow portion comprising a prod and a stock attached to the prod. A bumper comprises the forwardmost surface of the crossbow. The bumper comprises first contacting surface and a second contacting surface. The first contacting surface is oriented at a non-zero angle to the second contacting surface.

20 Claims, 6 Drawing Sheets

CROSSBOW BUMPERS

CROSS-REFERENCE TO RELATED APPLICATIONS

This application claims the benefit of U.S. Patent Application No. 62/567,092, filed Oct. 2, 2017, the entire content of which is hereby incorporated herein by reference.

BACKGROUND OF THE INVENTION

This invention relates generally to crossbows and more particularly to crossbows having footers or bumpers.

During a crossbow cocking operation, a user can secure the crossbow on the ground by stepping on a stirrup. A stirrup is often the forward-most structure of a crossbow, and can be unsightly and bulky. A stirrup may have a relatively small contact patch with the ground, acting as a pivot point rather than providing a desirable level of stability.

There remains a need for novel crossbow designs that provide improvements over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a bow portion comprising a prod and a stock attached to the prod. A bumper comprises the forwardmost surface of the crossbow. The bumper comprises first contacting surface and a second contacting surface. The first contacting surface is oriented at a non-zero angle to the second contacting surface.

In some embodiments, the non-zero angle ranges from 10 to 30 degrees.

In some embodiments, a crossbow comprises a second bumper shaped similar to the first bumper.

In some embodiments, a crossbow comprises a bow portion comprising a prod and a stock attached to the prod, the stock defining a shooting axis. A first bumper and a second bumper are located on opposite sides of the shooting axis. The first and second bumpers comprise the forwardmost surfaces of the crossbow.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
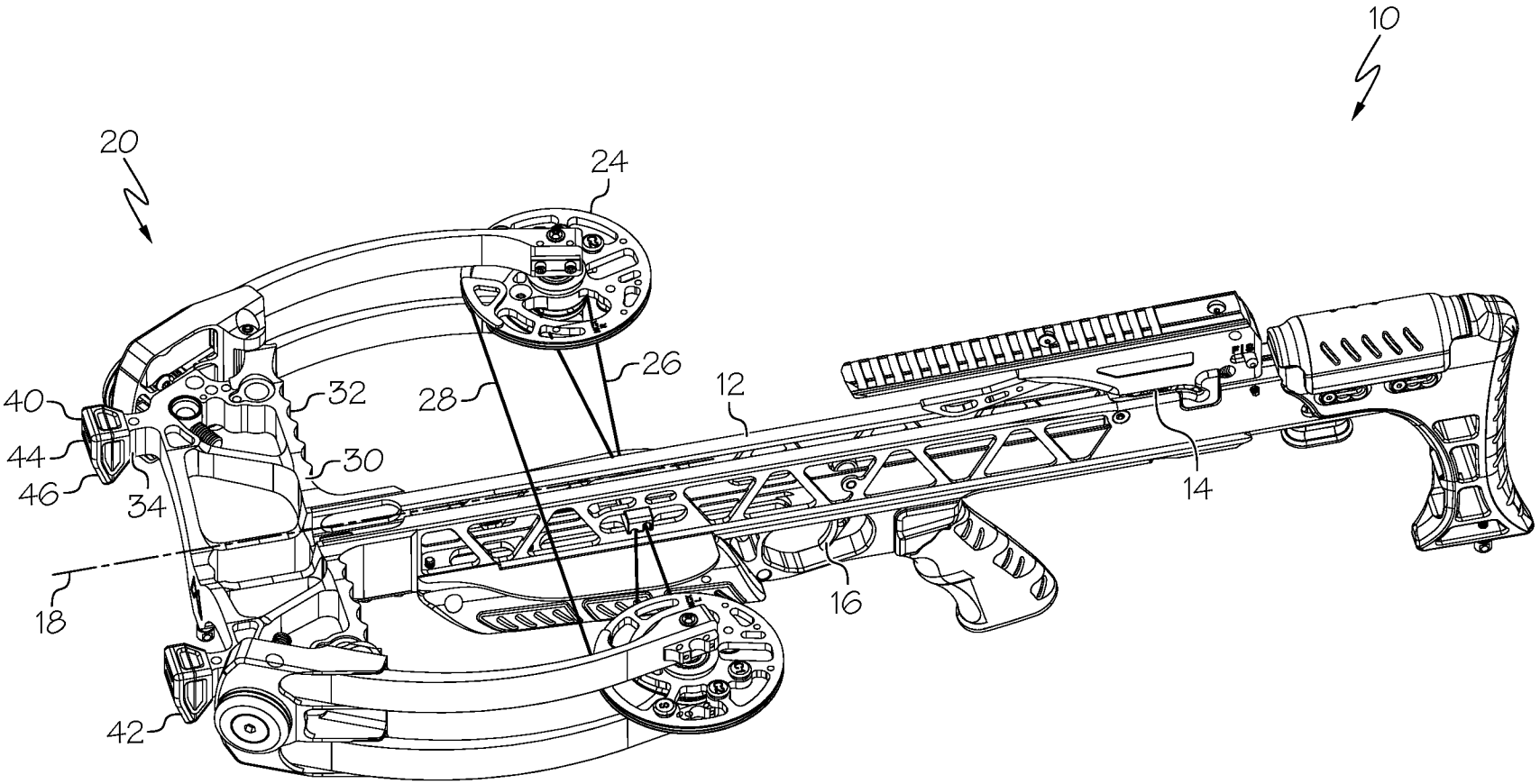
FIGS. 1-3 show views of an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
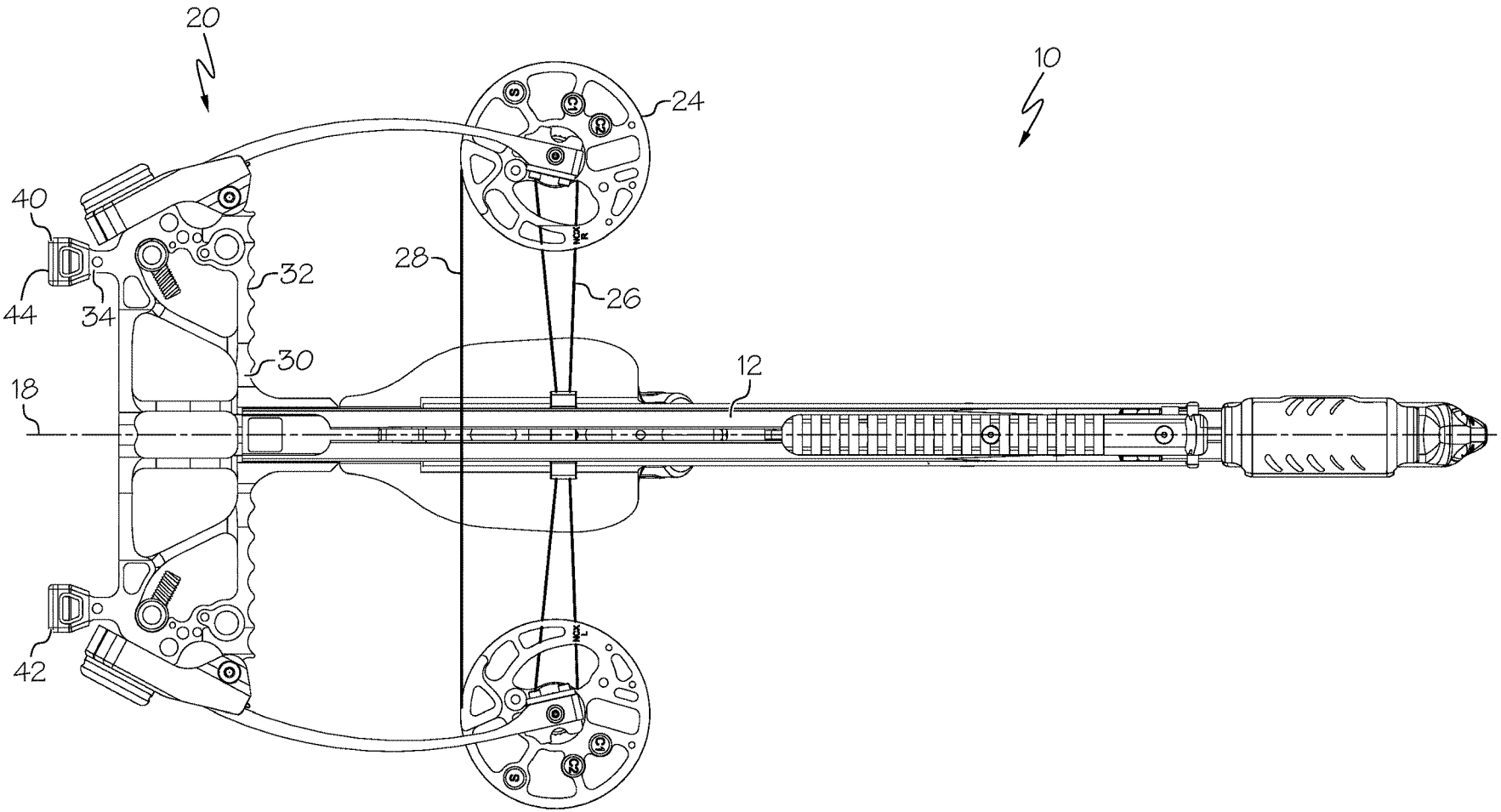
Figure 3:
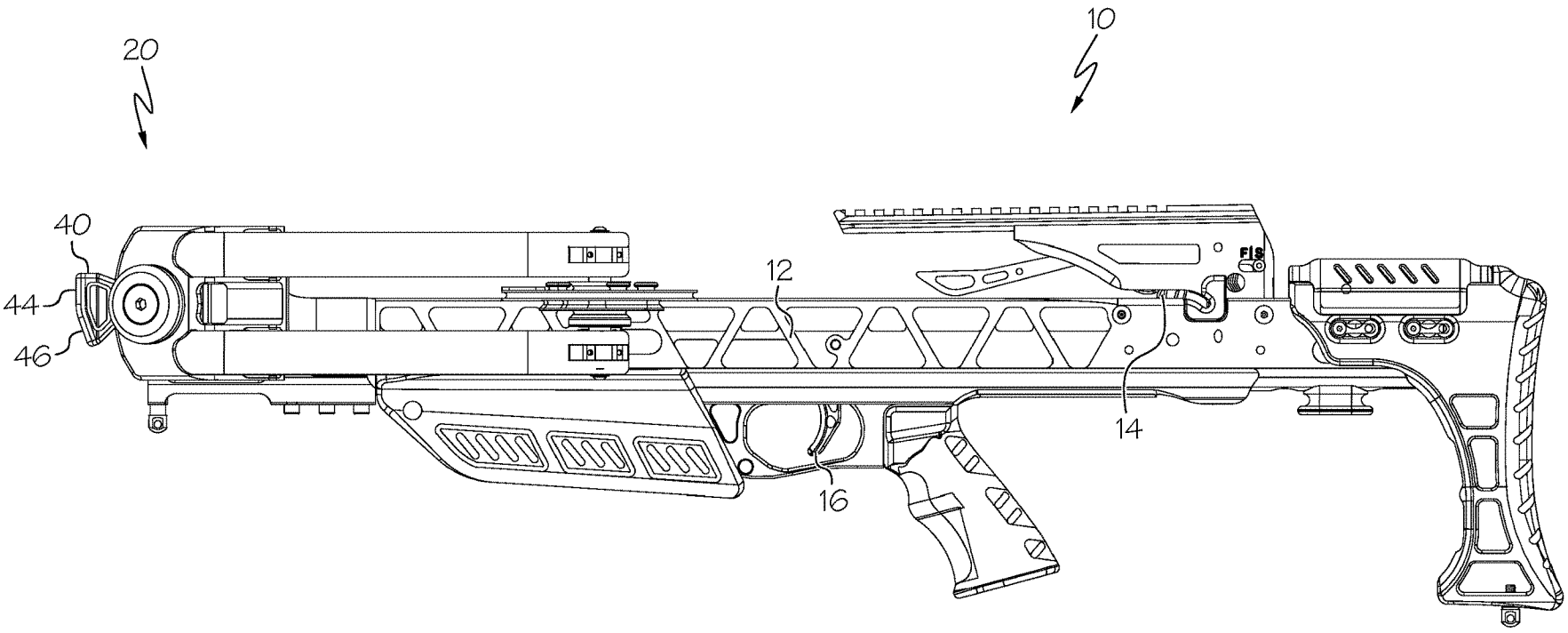

FIGS. 1-3 show views of an embodiment of a crossbow 10. In some embodiments, a crossbow 10 comprises a stock 12, a latch 14, a trigger 16 and a bow portion 20. In some embodiments, a bow portion 20 comprises a prod 30, at least one limb 22 and a bowstring 28. In some embodiments, the bow portion 20 comprises a compound bow, for example having one or more rotatable members 24 and at least one power cable 26.

In some embodiments, the prod 30 is attached to the stock 12. In some embodiments, the prod 30 and the stock 12 comprise a self-aligning attachment interface, for example as disclosed in U.S. Pat. No. 9,341,430.

In some embodiments, the prod 30 comprises a foot-engagement surface 32 suitable to engage a foot, for example as disclosed in U.S. Pat. No. 9,618,294. In some embodiments, the foot-engagement surface 32 comprises a treaded surface, a plurality of protrusions and recesses, etc. In some embodiments, foot-engagement surface(s) are provided on a first side (e.g. rear side) of the prod 30, and the bumper(s) 40 are provided on a second side (e.g. front side or opposite side) of the prod 30.

In some embodiments, the crossbow 10 comprises a bumper 40. In some embodiments, a bumper 40 is constructed and arranged to contact the ground or supporting surface as the crossbow 10 is being cocked. In some embodiments, the bumper 40 comprises the forwardmost structure of the crossbow 10. In some embodiments, the bumper 40 extends forward beyond the bow portion 20 and beyond the stock 12.

In some embodiments, the crossbow 10 comprises a second bumper 42. In some embodiments, the first bumper 40 and second bumper 42 are located on opposite sides of the shooting axis 18.

In some embodiments, a bumper 40 comprises an elastomeric material or other material that provides a relatively high coefficient of friction, which helps the bumper 40 to engage a supporting surface.

In some embodiments, a bumper 40 comprises a first surface portion 44 and a second surface portion 46, wherein the second surface portion 46 is oriented at a non-zero angle to the first surface portion 44. Desirably, each of the surface portions 44, 46 provides a stable base for the crossbow 10 in a predetermined orientation.

In some embodiments, the first surface portion 44 is oriented orthogonal to the shooting axis 18.

In some embodiments, the second surface portion 46 is oriented at an angle to the first surface portion 44, with the angle ranging from approximately 10 degrees to approximately 45 degrees. In some embodiments, the angle ranges from 10 to 30 degrees. In some embodiments, the angle ranges from 15 to 25 degrees. As shown in FIG. 3, the second surface portion 46 is oriented at approximately 20 degrees to the first surface portion 44.

In some embodiments, the first surface portions 44 of the first bumper 40 and the second bumper 42 are oriented on a common plane. In some embodiments, the common plane is orthogonal to the shooting axis 18. In some embodiments, the second surface portions 46 of the first bumper 40 and the second bumper 42 are oriented on a second common plane.

In some embodiments, the bumper(s) 40, 42 are attached to the prod 30. In some embodiments, the prod 30 comprises a leg 34 arranged to receive the bumper 40. In some embodiments, a leg 34 extends forward beyond any other portion of the prod 30.

Figure 4:
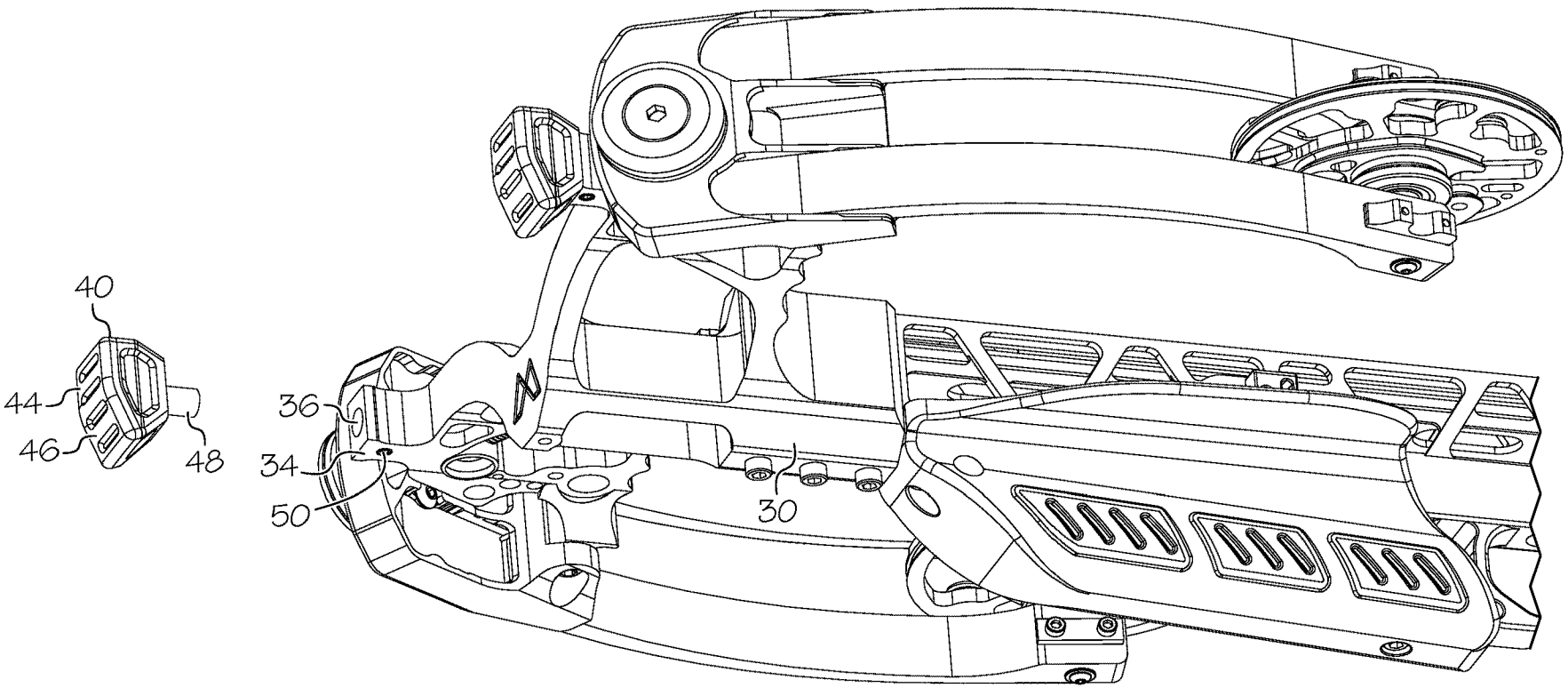
FIG. 4 shows an embodiment of a crossbow with a bumper disengaged.

FIG. 4 shows an embodiment of a prod 30 and an embodiment of a bumper 40 detached from the prod 30. In some embodiments, the prod 30 comprises a leg 36 extending outward from a body of the prod 30. In some embodiments, a leg 36 is provided for each bumper 40. In some embodiments, the leg(s) 36 comprise the forwardmost surface(s) of the prod 30. In some embodiments, the leg 34 comprises a cavity 36 arranged to receive a portion of a bumper 40. In some embodiments, a bumper 40 comprises a stem 48 that is received in the cavity 36. In some embodiments, a fastener 50 is used to attach the bumper 40 to the prod 30, such as a set screw.

Figure 5:
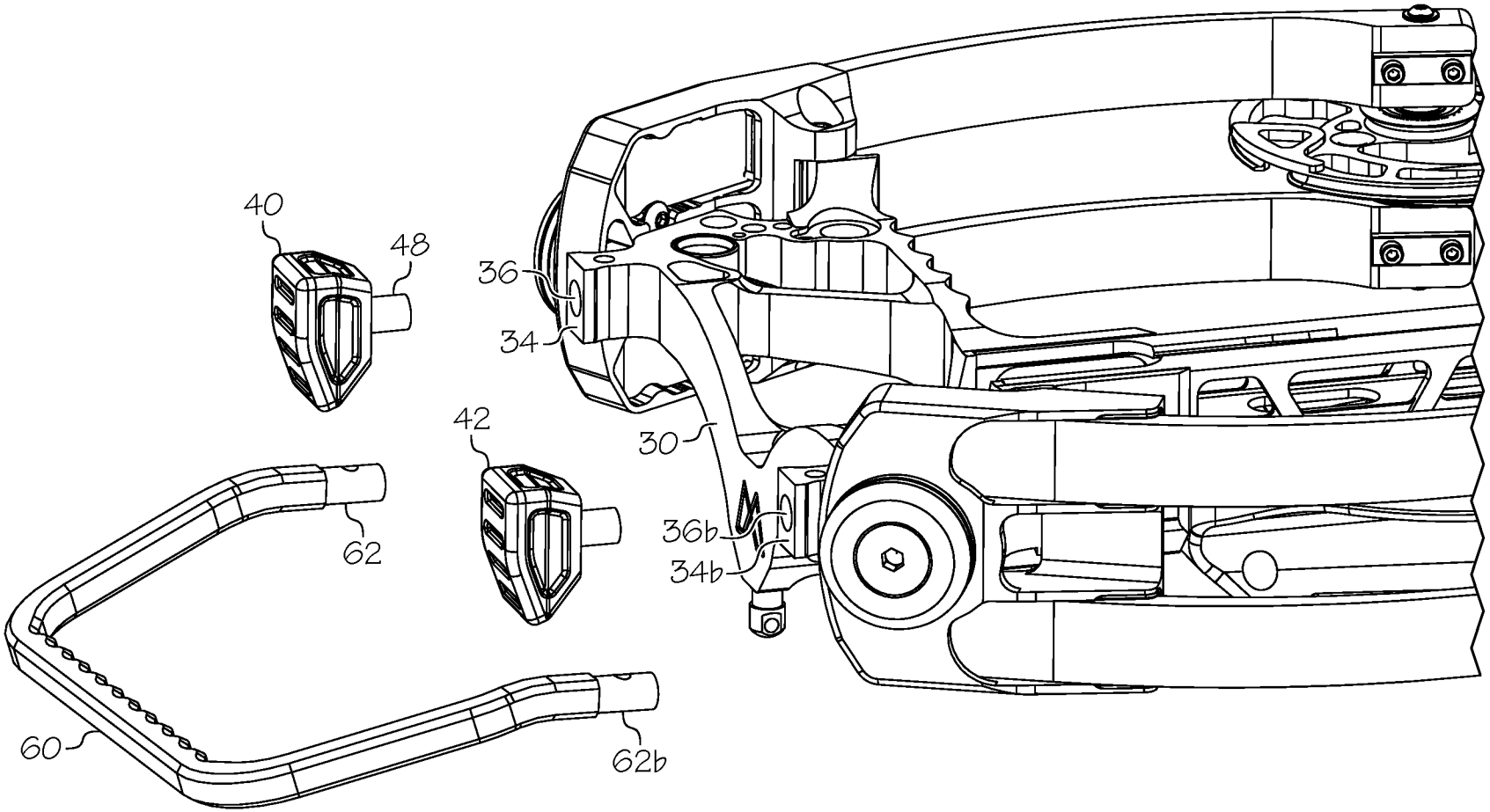
FIG. 5 shows an embodiment of a crossbow with bumpers and a stirrup.

FIG. 5 shows the crossbow 10 of FIG. 4 with both bumpers 40, 42 disengaged from the prod 30. In some embodiments, a prod 30 comprises a first leg 34 arranged to engage a first bumper 40 and a second leg 34*b* arranged to engage a second bumper 42.

In some embodiments, the crossbow 10 further comprises a stirrup 60 that can be received by the prod 30. In some embodiments, the stirrup 60 can be received in the cavities 36 that are arranged to receive a bumper 40. In some embodiments, a stirrup 60 comprises a first stem 62 and a second stem 62*b*, and a stem 62 of a stirrup 60 can be sized and shaped similarly to the stem 48 of a bumper 40. In some embodiments, a first stirrup stem 62 can be received in a cavity 36 of a first leg 34, and a second stirrup stem 62*b* can be received in a cavity 36 of a second leg 34*b*.

Figure 6:
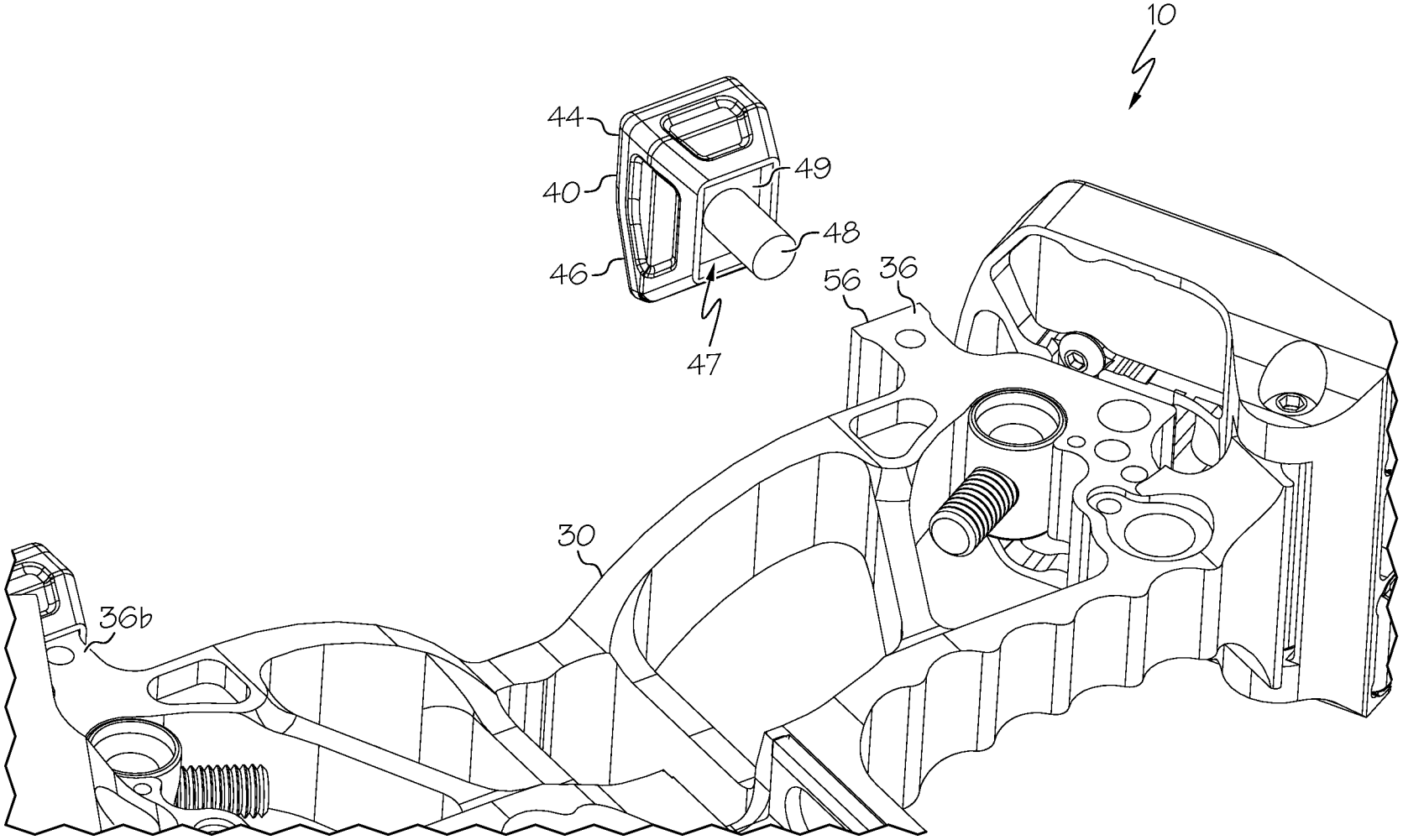
FIG. 6 shows another view of an embodiment of a crossbow with a bumper disengaged.

FIG. 6 shows another view of an embodiment of a crossbow 10. In some embodiments, a leg 36 comprises a contacting surface 56. In some embodiments, the contacting surface 56 comprises the forwardmost portion of the prod 30.

In some embodiments, a bumper 40 comprises a cavity 47. In some embodiments, a portion of the leg 36 is oriented in the cavity 47. In some embodiments, the cavity 47 comprises a floor 49, and the floor 49 abuts the contacting surface 56 of the leg 36.

In some embodiments, a stem 48 extends from the cavity 47 of the bumper 40. In some embodiments, a stem 48 extends from the floor 49 of the cavity 47.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a bow portion comprising a prod;

a stock attached to the prod;

a bumper, the bumper comprising a forwardmost surface of the crossbow, the bumper comprising a first contacting surface and a second contacting surface, the first contacting surface oriented at a non-zero angle to the second contacting surface.

2. The crossbow of claim 1, the non-zero angle ranging from 10 degrees to 30 degrees.

3. The crossbow of claim 1, the non-zero angle ranging from 15 degrees to 25 degrees.

4. The crossbow of claim 1, the bumper attached to the prod.

5. The crossbow of claim 4, the prod comprising a foot-engagement surface.

6. The crossbow of claim 5, the foot-engagement surface located on a first side of said prod, the bumper located on a second side of said prod.

7. The crossbow of claim 4, the prod comprising a leg, the bumper attached to the leg.

8. The crossbow of claim 7, the leg comprising a cavity, the bumper comprising a stem oriented in the cavity.

9. The crossbow of claim 7, the leg comprising a forwardmost surface of the prod.

10. The crossbow of clam 7, the leg comprising a contacting surface, the bumper comprising a cavity comprising a floor, the contacting surface contacting the floor.

11. The crossbow of claim 1, comprising a second bumper, the second bumper comprising a first contacting surface and a second contacting surface.

12. The crossbow of claim 11, wherein the first contacting surface of the first bumper and the first contacting surface of the second bumper are aligned on a common plane.

13. The crossbow of claim 12, wherein the second contacting surface of the first bumper and the second contacting surface of the second bumper are aligned on a second common plane.

14. A crossbow comprising:

a bow portion comprising a prod, a stock attached to the prod, the stock defining a shooting axis;

a first bumper and a second bumper located on opposite sides of the shooting axis, the first bumper and second bumper comprising the forwardmost surfaces of the crossbow, the first bumper comprising a first contacting surface and a second contacting surface oriented at a non- zero angle to the first contacting surface.

15. The crossbow of claim 14, a first side of the prod comprising a foot-engagement surface, the first bumper attached to a second side of the prod.

16. The crossbow of claim 14, the non-zero angle ranging from 10 degrees to 30 degrees.

17. The crossbow of claim 16, the second bumper comprising a first contacting surface and a second contacting surface oriented at a non-zero angle to the first contacting surface.

18. The crossbow of claim 14, the prod comprising a first leg and a second leg, the first bumper attached to the first leg, the second bumper attached to the second leg.

19. The crossbow of claim 18, the first leg comprising a cavity, the first bumper comprising a stem oriented in the cavity.

20. A crossbow comprising:

a bow portion comprising a prod, a stock attached to the prod, the stock defining a shooting axis;

a first bumper and a second bumper located on opposite sides of the shooting axis, the first bumper and second bumper comprising the forwardmost surfaces of the crossbow, a first side of the prod comprising a foot-engagement surface, the first bumper attached to a second side of the prod.

* * * * *